United States Patent [19]

Peeters

[11] Patent Number: 4,722,418

[45] **Date of Patent: * Feb. 2, 1988**

[54] LOUDSPEAKER ENCLOSURE

[76] Inventor: Robert D. Peeters, 712 McDuff Ave., Fremont, Calif. 94539

[ * ] Notice: The portion of the term of this patent subsequent to Jul. 14, 2004 has been disclaimed.

[21] Appl. No.: 890,003

[22] Filed: Jul. 25, 1986

Related U.S. Application Data

[63] Continuation of Ser. No. 446,425, Dec. 2, 1982, Pat. No. 4,679,651.

[51] Int. Cl.[4] ..... G10K 11/00

[52] U.S. Cl. ..... 181/155

[58] Field of Search ..... 181/155, 175, 156, 199, 181/198, 151, 153, 154, 144–149

[56] References Cited

U.S. PATENT DOCUMENTS

| | | | |
|---|---|---|---|
| D. 253,108 | 10/1979 | Schroeder | 181/147 X |
| 2,694,463 | 11/1954 | Robbins et al. | 181/155 |
| 2,840,178 | 6/1958 | Boleslav | 181/155 |
| 3,089,562 | 5/1963 | Morgillo | 181/156 |
| 3,239,028 | 3/1966 | Murray | 181/154 |
| 3,517,769 | 6/1970 | Broussand | 181/155 |
| 4,146,111 | 3/1979 | Mae et al. | 181/155 X |

*Primary Examiner*—L. T. Hix
*Assistant Examiner*—Brian W. Brown

[57] ABSTRACT

A loudspeaker enclosure, for a loudspeaker with a diaphragm, having a front wall, a mounting and spacing device for mounting the loudspeaker spaced from the front wall such that there is significant air friction in the back wave passing through the space between loudspeaker and front wall, and an aperture defined in the front wall which is substantially smaller than the diaphragm. The enclosure can include an elliptical panel mounted to the diaphragm and spaced from the front wall. The enclosure provides for a greater bass sound and a flattened frequency response curve, as well as other improved acoustic qualities.

17 Claims, 17 Drawing Figures

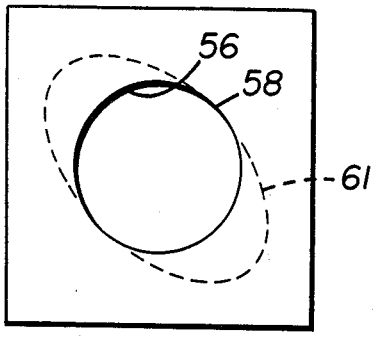
FIGURE 13
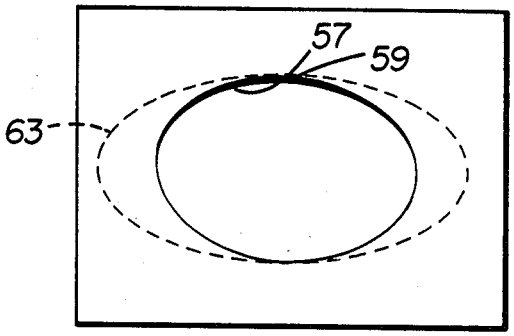
FIGURE 14
FIGURE 16
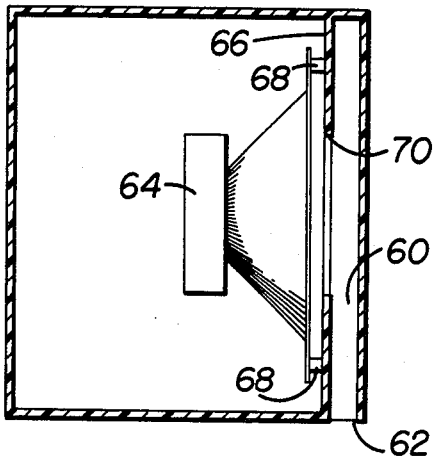
FIGURE 15
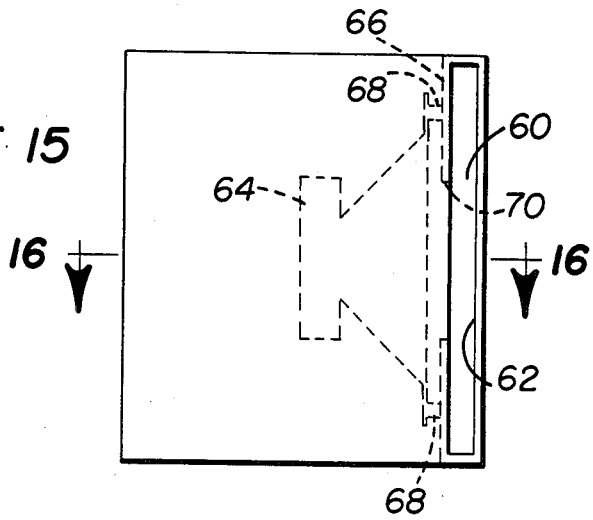

LOUDSPEAKER ENCLOSURE

DESCRIPTION

1. Technical Field

The present invention is directed to a loudspeaker enclosure and in particular to an enclosure for providing a sound frequency curve with a flatter response, relatively more bass and depth of sound, and more warmth, aliveness, and lack of irritation in the sound quality.

2. Background Art

While a great number of loudspeaker enclosures are commercially similar, there is generally a direct proportional relationship between the cost of such enclosure and speaker and the quality of the sound produced thereby. There is a need to provide low cost, but high quality loudspeaker enclosure which provide a great depth of sound for the volume enclosed, and that provides a flatter frequency curve response so that highs and lows which occur at various frequencies are evened out. There is a need to provide such loudspeaker enclosures which produce more bass. Additionally, there is a need to provide more warmth, aliveness, and lack of irritation in the sound quality.

The present invention is directed to overcoming one or more of the problems as set forth above.

DISCLOSURE OF THE INVENTION

In one aspect of the invention, a loudspeaker enclosure for a loudspeaker with a diaphragm comprises a housing with a front wall, mounting and spacing means adapted for mounting the loudspeaker spaced from said front wall for communicating a space enclosed by the loudspeaker enclosure with the environment and an aperture defined by said front wall, said aperture being substantially smaller than the diaphragm of the loudspeaker and having a configuration which is different from the diaphragm. The loudspeaker is spaced from the front wall a restricted distance such that there is significant air friction in the back wave passing through this loudspeaker set back space, this air friction delaying passage of the back wave.

In another aspect of the invention, the enclosure is comprised of moldable plastic.

In yet another aspect of the invention, the loudspeaker enclosure includes an elliptical panel positioned adjacent the diaphragm and spaced from the front wall.

In still another aspect of the invention, the loudspeaker enclosure includes a chamber means located in front of and communicating with the aperture for allowing sound to exit therefrom substantially perpendicular to the direction of travel of the sound from the loudspeaker.

Accordingly, the present invention provides for a loudspeaker enclosure which allows both back waves and front waves to radiate forwardly from the loudspeaker to the environment, the back waves radiating through the space between the front wall and the loudspeaker. The aperture and the elliptical panel vary the distance the back wave travels so as to flatten the frequency response curve and so as to increase the bass. The air friction delaying the back wave passing through the loudspeaker set back space contributes to depth, warmth, aliveness and lack of irritation sound qualities, and also contributes to flattening the frequency response curve. Further, the chamber means mounted in front of the front panel gives a greater bass sound. Also, the above arrangement can be economically manufactured by use of plastic in an injection molding process. Also the enclosure of the present invention improves the performance of less expensive speakers placed therein.

BRIEF DESCRIPTION OF THE DRAWINGS

FIGS. 8 through 14 are front views of other embodiments of the loudspeaker enclosure of the invention.

FIG. 15 is a side cross-sectional view of another embodiment of the loudspeaker enclosure of the invention.

FIG. 16 is another side cross-sectional view of the embodiment of FIG. 15, through line 16—16.

DETAILED DESCRIPTION OF THE PREFERRED EMBODIMENT

Figure 1:
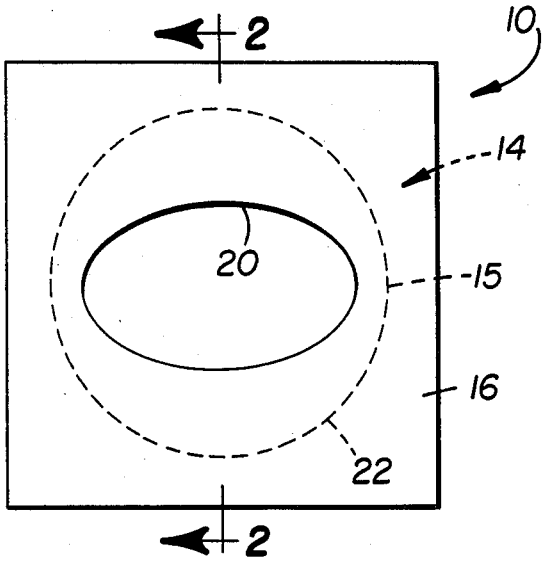
FIG. 1 is a front view of an embodiment of the loudspeaker of the invention.
Figure 2:
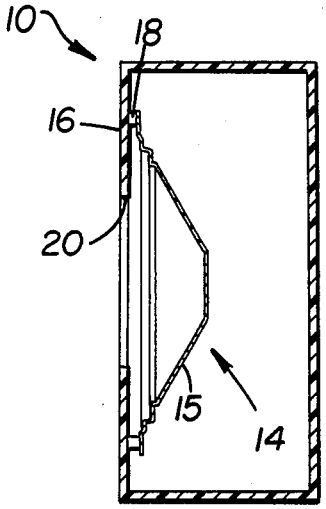
FIG. 2 is a side cross-sectional view of the embodiment of FIG. 1, through line 2—2.

With reference to the figures and in particular to FIGS. 1 and 2, an embodiment of the loudspeaker enclosure of the invention is depicted and denoted by numeral 10. Loudspeaker enclosure 10 includes a housing 12 which in this embodiment has substantially rectangular walls. It is to be understood though that housing 12 can also be an amorphous shaped enclosure (not shown). A loudspeaker 14 with diaphragm 15 is mounted to the inside of the front wall 16 by spacers 18 or other devices. In a preferred embodiment, the loudspeaker 14 is set back up to about one-eighth ($\frac{1}{8}$) inch from the front wall 16. Diaphragm 15 of the loudspeaker 14 is substantially circular. Front wall 16 includes an elliptical opening 20 which defines, in a preferred embodiment, a substantial smaller opening than does the maximum opening 22 of diaphragm 15. Elliptical opening 20 is substantially centered inside opening 22.

Figure 5:
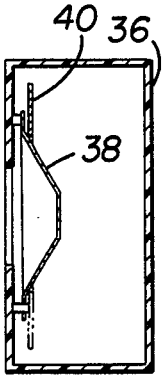
FIG. 5 is a side cross-sectional view of the embodiment of FIG. 4, through line 5—5.

The set back allows back waves from the loudspeaker to enter the listening space external to the enclosure 10. Also in another preferred embodiment a portion of the loudspeaker 14 is set back further from the front wall 16 than the rest of loudspeaker 14 (FIG. 5). Because of the reduced size of the elliptical opening 20 and the back wave pressure extending into the space between the loudspeaker 14 and the front wall 16, acoustical pressures are substantially equalized in front and in back of the loudspeaker with the result that the loudspeaker does not tend to overload with much increased bass output.

The narrower the ellipse is, the more bass that can be accomplished. However, the same narrowing of the ellipse is at the expense of the volume of mid and high range frequencies due to the fact that these frequencies are more directional than bass frequencies and thus tend to become lost. A serviceable range of aperture size substantially smaller than the diaphragm is approximately one-quarter to three-quarters the diaphragm area.

The elliptical opening 20 performs in the following manner. Due to impedence and resonance factors, somewhat analogous to different lengths of pipes in an organ, each frequency that travels in the back wave from behind the speaker to where it is released at the opening 20 in front of the speaker has an optimum distance that it should go before it is released. Using elliptical opening 20, there are in infinite number of distances within the limits of the physical dimensions for the back wave to travel. Thus, as a range of frequencies are emphasized somewhere on the ellipse, these frequencies tend to be evened out with no small range of just a few frequencies that stand out. Consequently, elliptical opening 20 gives a more inclusive curve of all the frequencies for a fuller range sound.

The back of the enclosure is preferably packed with fiberglass wool or other suitable material (not shown) to increase air friction, which makes the enclosure space "look" acoustically larger still. In mass manufacture, it is anticipated that a moulded plastic housing will enclose the loudspeaker.

The restriction of air friction in the loudspeaker set back in this invention as compared to the restrictions in prior art is rather analogous to the restriction of air friction in a compression release for a motorcycle as compared with no compression release, the latter not having such significant air friction.

While within a set back of up to about one-eighth inch the ordinary artisan will readily determine the precise optimum set back for the large majority of loudspeakers, of whatever size, it is comprehensible that for some loudspeakers with larger than a ten inch diameter diaphragm, partially due to design variations, that when such loudspeakers are intended to be used routinely towards their maximum wattage, that a set back of up to about one-quarter ($\frac{1}{4}$) inch will be needed. Another value of specifying a set back of up to about $\frac{1}{4}$ inch is that while in the large majority of cases the improvements in this invention reduce significantly at a larger set back than up to about $\frac{1}{8}$ inch for any size loudspeaker, a set back of up to about $\frac{1}{4}$ inch, still being a reduced restriction, will protect this invention idea even from manufacturers willing to have what would be inferior results in the inventor's estimation.

This invention can be seen as an improvement on infinite baffle enclosures. Utilizing the same dimensions for any front, back, side, top and bottom walls as is commonly agreed is acceptable for an infinite baffle enclosure for any given loudspeaker, by applying to this infinite baffle enclosure the invention difference of restricted set back, and also possibly reduced size front aperture, etc.—the presented acoustic advantages of this invention appear as compared to the otherwise infinite baffle enclosure. Or—approximately the same sound can be acquired as a full size infinite baffle enclosure, such infinite baffle enclosure's dimensions not reduced for miniaturization for instance for book shelf application, by reducing that larger infinite baffle enclosure's volume in many cases to as little as one third, proportionately reducing the infinite baffle enclosure's dimensions, but applying the invention difference. Or, somewhat reduce the volume of the infinite baffle enclosure while somewhat improving its sound quality, in the application of the invention.

Figure 3:
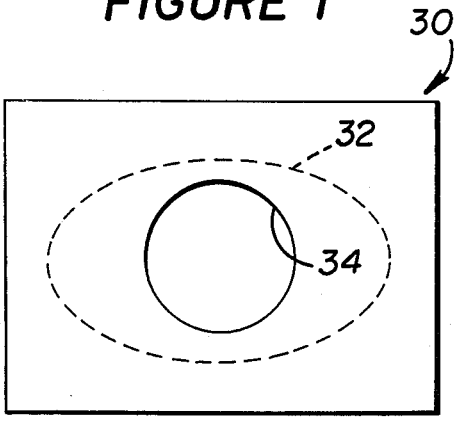
FIG. 3 is a front view of another embodiment of the loudspeaker enclosure of the invention.

Another embodiment of the loudspeaker enclosure 30 of this invention utilizes an elliptical speaker 32 (FIG. 3), which is spaced back from the front wall, but in this case the front wall having a circular opening 34. Here, once again, the different lengths of back wave travel from where the back wave comes around the edge of the elliptical speaker to where the back wave passes the circular opening, allow an infinite number of different distances, so that all frequencies are somewhere emphasized and tend to even out for a flatter overall response.

Opening 34 is substantially smaller than the diaphragm of loudspeaker 32 and centered with respect thereto.

Figure 6:
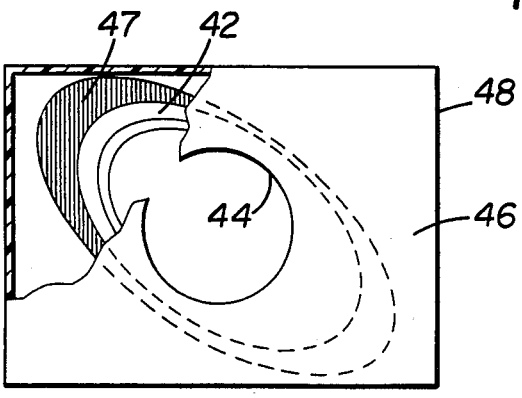
FIG. 6 is a front view of yet another embodiment of the loudspeaker enclosure of the invention.

There is still another way to further vary the length of travel of the back waves. This is to add another portion of an ellipse to the traveling length as shown in enclosure 36 which has speaker 38 (FIGS. 5, 6). This is affected by attaching at the back of the speaker 38 a further panel 40 in the shape of a portion of an ellipse. The maximum travel distance for some of the back waves is longer while the minimum distance stays the same due to no additional travel distance being added in some direction by panel 40. The longer the maximum distance, the more bass that is obtained. This variation in the traveling lengths for the back waves provides for a different flattening of the frequency curve, with for some frequencies more optimum traveling distances being provided. FIG. 6 shows an elliptical speaker 42 with a circular opening 44 in front wall 46 and with an elliptical panel 47 secured to the speaker 42 as in FIG. 5 of enclosure 36.

Figure 7:
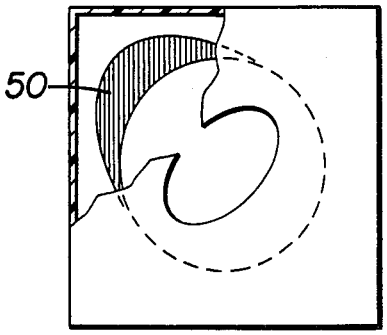
FIG. 7 is a front view of another embodiment of the loudspeaker enclosure of the invention.
Figure 8:
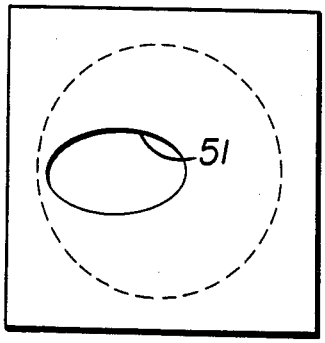
Figure 9:
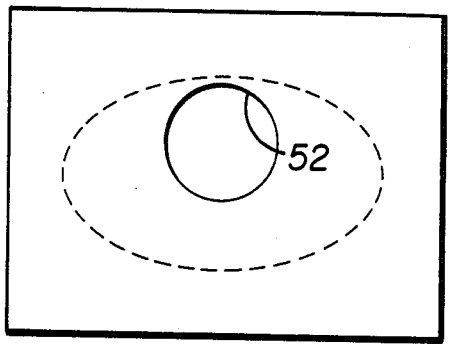

This additional panel (FIGS. 5, 6, 7) is attached at the back of the speaker by the screws which hold the speaker to the front panel of the enclosure. Alternately, the panel can be attached to the front wall by appropriate plastic mold construction.

Figure 4A:
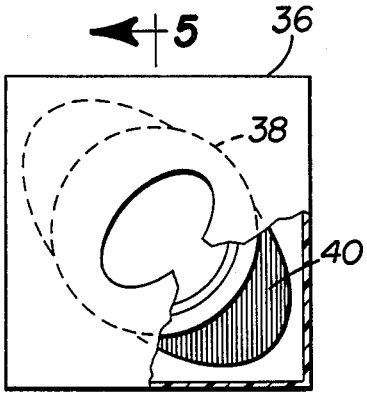
FIGS. 4A and 4B are front views of still another embodiment of the loudspeaker of the invention.

A full elliptical panel, such as panel 40 (FIG. 4A), does not have to be used with each speaker. Only half of such a panel as panel 50 can be used (FIG. 7) to give increased bass. Panel 47 gives greater bass than does panel 50. It is to be understood that panels such as panels 50 and 47 can be added to any of the above embodiments and to the embodiment in FIGS. 8 through 12 and 15, 16. Note that by having the longest diameter of the speaker (FIGS. 4A, 4B, 6) aligned along the diagonal of the enclosure, the greatest conservation of space is achieved.

Figure 4B:
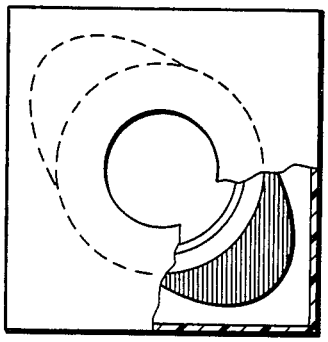

Two aspects of this invention, the front and back loading and the variation of the lengths of the back wave travel path, can be accomplished in another fashion. The front loading can be accomplished by a smaller aperture, though of the same configuration as the diaphragm, with the varying back wave travel lengths accomplished by elliptical panels (FIG. 4B).

The openings 51, 52, 53, 54, 55, in the panel in front of the speaker does not need to be centered in front of the speaker (FIGS. 8 through 12). An advantage of centering is that front loading on the speaker is fairly much the same all the way around the speaker to minimize uneven mechanical stresses on voice coil alignment. The opening being set off at the side allows the sound a greater maximum travel distance and a smaller minimum travel distance.

Figure 10:
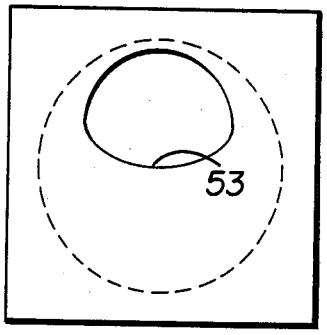
Figure 11:
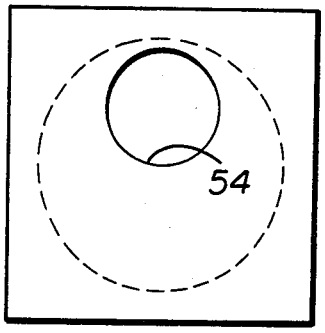
Figure 12:
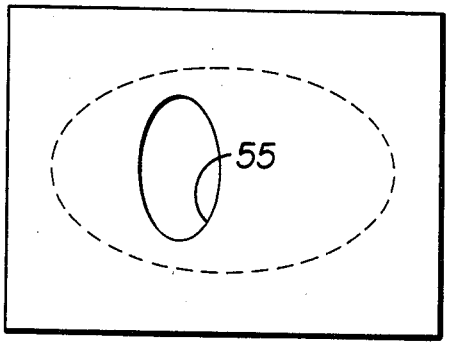

While the opening can be other shapes than ellipse or circles or combinations of the two as in FIG. 10, other variations using an otherwise curved outline or an outline with some straight edges could be considered. But the preference is with circular and elliptical openings.

It is to be noted that some results can be had by setting the speaker back from the front side and using a panel, such as panel 40, without using a reduced opening 20. Use of the panel and setting the speaker back will cause varying distances of back wave travel, aiding to flattening out of the frequency response. FIG. 13 and FIG. 14 show two variations of this arrangement. Openings 56, 57 are of the same size as diaphragms 58, 59. Elliptical panels 61, 63 are associated therewith. Such elliptical panels can be applied to existing speakers without a variation in the existing front panel. Spacers can be used to set the speaker back from the front panel and elliptical panel can be positioned against the speaker.

Any elliptical panels or partially elliptical panel may be bent back from being substantially parallel with the front wall, so as to allow for greater length of such panels.

Some results of the specified acoustic benefits are to be acquired with just the invention range of loudspeaker set back applied to infinite baffle enclosures, with none of the means provided to vary back wave travel and no front loading, though this is not a preferred embodiment.

Comparing the bass in an infinite baffle enclosure, without this improvement, for example, there is much pressure or vacuum behind the speaker maintained within the enclosure but little pressure or vacuum in front of the speaker as the pressure in front quickly dissipates away. Under these conditions, if the bass part of the signal going to the speaker were significantly increased, overloading would quickly occur. This invention with the significantly smaller opening in front allows there to be, in effect, a chamber in front of, as well as, behind the speaker, with pressure or vacuum being maintained in this chamber because of the smaller opening. This gives a balancing of pressure, front and rear, with the result that there can be a large increase of the bass signal without there being overloading.

Therefore, the basic way this invention gives more bass is that it allows the bass signal to be more increased, without the objectionable sounds of overloading.

In addition to an opening such as opening 20 in FIG. 1, another way to get more bass is to have a channel 60 placed outside the wall to which the bass speaker is attached. As in FIGS. 15, 16, the base sound is released into this channel 60, and the sound is released from this channel into the listening space at only one open end 62 of the channel 60.

In this embodiment, the speaker 64 is spaced back from the front panel 66 by spacers 68 and front panel 66 includes an opening 70 which is smaller than speaker 64. Opening 70 also can do well to have a different configuration from speaker 64. Channel 60, optionally packed with fiberglass, provides low frequency ranges only, and higher ranges can be provided for instance by midrange and tweeter speakers in the wall facing the same direction as the open end 62 of channel 60.

From the above, it can be seen that the present invention provides for more bass sound, a flatter frequency response curve, greater depth of sound, as if the sound was coming from an enclosure with much greater volume, and greater economy in enclosure manufacture.

Other aspects, objects and advantages of this invention can be obtained from a study of the drawings, the disclosure and the appended claims.

While the above description contains many specificities, these should not be construed as limitations on the scope of the invention, as many other variations are possible. Accordingly, the scope of the invention should be determined not by the embodiments illustrated, but by the appended claims and their legal equivalents.

I claim:

1. A loudspeaker and enclosure comprising: a housing having an opening therein, said opening defined by an aperture in a front wall of said housing;

a loudspeaker with a diaphragm, said diaphragm including a peripheral mounting portion at the mouth thereof;

means attached to said front wall and said peripheral mounting portion of said diaphragm, said means mounting said loudspeaker inside said housing with the mouth of said diaphragm facing said front wall, and said means spacing the peripheral mounting portion of said diaphragm from said front wall in the range of above zero up to one-eighth inch.

2. A loudspeaker and enclosure comprising: a housing having an opening therein, said opening defined by an aperture in a front wall of said housing;

a loudspeaker with a diaphragm, said diaphragm including a peripheral mounting portion at the mouth thereof;

means attached to said front wall and said peripheral mounting portion of said diaphragm, said means mounting said loudspeaker inside said housing with the mouth of said diaphragm facing said front wall, and said means spacing the peripheral mounting portion of said diaphragm from said front wall in the range of above zero up to one-quarter inch for such said diaphragm having a diameter larger than ten inches.

3. A loudspeaker and enclosure comprising: a housing having an opening therein, said opening defined by an aperture in a front wall of said housing;

a loudspeaker with a diaphragm, said diaphragm including a peripheral mounting portion at the mouth thereof;

said aperture being substantially smaller than said diaphragm;

means attached to said front wall and said peripheral mounting portion of said diaphragm, said means mounting said loudspeaker inside said housing with the mouth of said diaphragm facing said front wall, and said means spacing the peripheral mounting portion of said diaphragm from said front wall in the range of above zero up to one-quarter inch.

4. The loudspeaker enclosure of claims 1, 2, or 3 wherein the loudspeaker is spaced from the front wall a shorter distance from one portion of the diaphragm than from an opposite portion of the diaphragm.

5. The loudspeaker enclosure of claim 3 wherein said aperture has a configuration which is different from said diaphragm.

6. The loudspeaker enclosure of claim 5 wherein the diaphragm is circular and the aperture is elliptical.

7. The loudspeaker enclosure of claim 5 wherein the diaphragm is elliptical and the aperture is circular.

8. The loudspeaker enclosure of claim 5 wherein the diaphragm is elliptical and the aperture is elliptical and the major diameter of the aperture is at right angles to the major diameter of the diaphragm.

9. The loudspeaker enclosure of claim 5 wherein the aperture is off center from the diaphragm.

10. The loudspeaker enclosure of claims 1, 2, or 5 wherein a partially elliptical panel is positioned adjacent the diaphragm and spaced from the front wall.

11. The loudspeaker enclosure of claims 1, 2, or 5 wherein a partially elliptical panel is positioned adjacent the diaphragm and spaced from the front wall.

12. The loudspeaker enclosure of claim 5 wherein the front wall is substantially rectangular and the aperture is elliptical with a major diameter directed into corners of the front wall.

13. The loudspeaker enclosure of claims 1, 2, or 3 wherein the housing is comprised of plastic.

14. The loudspeaker enclosure of claim 10 wherein the elliptical panel is attached to the loudspeaker.

15. The loudspeaker enclosure of claim 11 wherein the partially elliptical panel is attached to the loudspeaker.

16. The loudspeaker enclosure of claim 3 wherein the diaphragm and the aperture have the same general configuration.

17. A loudspeaker and enclosure comprising: a housing having an opening therein, said opening defined by an aperture in a front wall of said housing;

a loudspeaker with a diaphragm, said diaphragm including a peripheral mounting portion at the mouth thereof;

said aperture defined by said loudspeaker;

a substantially elliptical panel positioned adjacent said diaphragm and spaced from said front wall;

means attached to said front wall and said peripheral mounting portion of said diaphragm, said means mounting said loudspeaker inside said housing with the mouth of said diaphragm facing said front wall, and said means spacing the peripheral mounting portion of said diaphragm from said front wall in the range of above zero up to one-quarter inch.

* * * * *